United States Patent [19]

Chang

[11] 4,436,216

[45] Mar. 13, 1984

[54] RIBBED BASE CUPS

[75] Inventor: Long F. Chang, Sylvania, Ohio

[73] Assignee: Owens-Illinois, Inc., Toledo, Ohio

[21] Appl. No.: 412,673

[22] Filed: Aug. 30, 1982

[51] Int. Cl.[3] ..... B65D 23/00

[52] U.S. Cl. ..... 220/69; 215/1 C; 248/346.1

[58] Field of Search ..... 220/69, 72, 70, 85 H, 220/85 K; 215/1 C, 12 R; 248/346.1, 346

[56] References Cited

U.S. PATENT DOCUMENTS

| | | | |
|---|---|---|---|
| D. 28,483 | 4/1893 | Modes | 220/70 X |
| 1,890,323 | 12/1932 | Glaeser | 215/12 R |
| 2,847,144 | 8/1958 | Cornelius | 220/69 |
| 3,043,461 | 7/1962 | Glassco | 220/70 X |
| 3,268,198 | 8/1966 | Swett | 248/346.1 |
| 3,349,940 | 10/1967 | Cornelius | 220/69 X |
| 3,397,928 | 8/1968 | Galle | 308/8.2 |
| 3,449,024 | 6/1969 | Lichte | 308/8.2 |
| 3,467,448 | 9/1969 | Galle | 308/8.2 |
| 3,524,614 | 8/1970 | Sorth | 248/346.1 X |
| 3,656,764 | 4/1972 | Robinson | 308/8.2 |
| 3,722,021 | 3/1973 | Brainerd et al. | 220/85 H X |
| 3,752,243 | 8/1973 | Hummer et al. | 175/364 |
| 3,973,693 | 8/1976 | Brocklehurst | 220/70 X |
| 4,040,493 | 8/1977 | Saxman | 175/374 |
| 4,170,622 | 10/1979 | Uhlig | 215/1 C X |
| 4,249,622 | 2/1981 | Dysart | 175/227 |
| 4,326,638 | 4/1982 | Nickel et al. | 215/12 R |

FOREIGN PATENT DOCUMENTS

| | | | |
|---|---|---|---|
| 963318 | 2/1975 | Canada | 220/70 |
| 2883 | 5/1956 | Fed. Rep. of Germany | 220/70 |
| 1056341 | 4/1959 | Fed. Rep. of Germany | 220/70 |

OTHER PUBLICATIONS

Parker Seals, *O-Ring Handbook*, Published Jan. 1977, Parker Seal Company, Lexington, Ky., pp. 13–16.

*Primary Examiner*—Allan N. Shoap
*Assistant Examiner*—Robert Petrik
*Attorney, Agent, or Firm*—Thomas L. Farquer; M. E. Click

[57] ABSTRACT

A base cup for a container includes reinforcing ribs which provide both the requisite strength and rigidity and a reduction in weight. The ribs are preferably disposed on the inner surface of the base cup for cosmetic reasons and may be arranged in various generally symmetrical radial and circumferential patterns. Ribbed base cups fabricated according to the instant invention exhibit significant weight and material reductions over prior art designs while still providing necessary stability and support to the associated container.

22 Claims, 22 Drawing Figures

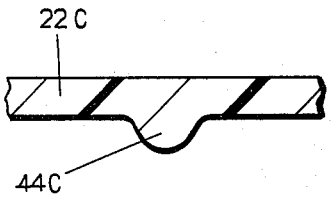
FIG. 18
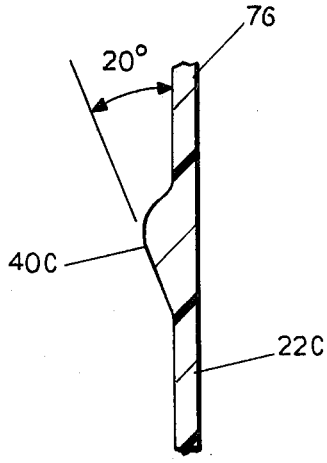
FIG. 19
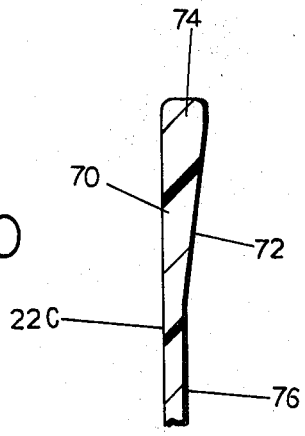
FIG. 20
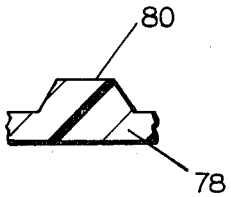
FIG. 21
FIG. 22
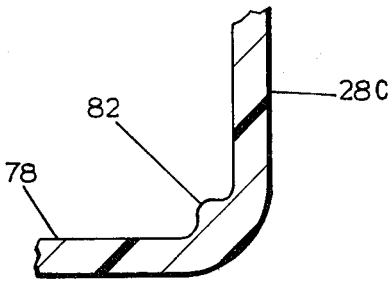

RIBBED BASE CUPS

BACKGROUND OF THE INVENTION

The invention relates generally to a support or base cup for a liquid container having a hemispherical bottom and more particularly to a base cup having reduced wall thickness and strategically located ribs which provide necessary strength and rigidity to the base cup while significantly reducing cup weight.

Blow molded multiple serving containers for liquids such as soft drinks, beer and carbonated waters have enjoyed significant market success in the last decade. Such success is the result of a confluence of events relating to both technological and manufacturing progress as well as intelligent marketing and ultimately, consumer acceptance.

For such consumer products, disposability resulting from intrinsically low per unit cost is a parameter which has had a major effect on the market for such containers. Blow molding fabrication techniques are partially responsible for initially achieving as well as maintaining such low costs. And orientable thermoplastic polymers are routinely utilized to fabricate containers having wall thicknesses on the order of 10 to 40 mils which readily withstand oftentimes large internal pressures which may be generated by carbonated beverages.

Due to the design flexibility which such materials and processes permit, numerous bottle shapes have been proposed. Certain designs place a premium on aesthetic values and others, perhaps due to the particular fluid or carbonation level of the fluid intended to be contained therein, place overriding importance on structural considerations. A third viewpoint places the greatest importance on the utilization of a minimum of material. One design which successfully responds to all three parameters is a bottle utilizing a hemispherical bottom. Obviously and unfortunately, however, such a bottle will not independently remain upright, either during filling steps in a bottling plant or in the environment of a consumer. This difficulty has been overcome by the addition of a circular base cup which receives the hemispherical bottom of the container and is secured thereto by an adhesive. The base cup maintains the container in a vertical or upright orientation. This two part container configuration has enjoyed extensive commercial success due to its responsiveness to the product needs delineated above.

Examination of the base cup structure itself reveals that one portion is structural and the other portion is cosmetic. The cosmetic portion can generally be defined as the sidewall which provides vertical continuity to the sidewall of the container in that region adjacent the hemispherical bottom portion. The structural portion of the base cup is generally the remainder of the cup which cradles the hemispherical end of the container and maintains it in a vertical orientation. The two regions are substantially exclusive. That is, the sidewall portion provides substantially no structural benefits and the bottom portion likewise does not offer cosmetic or aesthetic benefits. Armed with this knowledge, and the further knowledge that such containers and base cups are fabricated and utilized by the millions, it would appear to be a desirable goal to minimize the size and weight of the base cup in order to minimize material use.

A survey of the prior art reveals little that guides one toward this goal. U.S. Pat. Nos. 3,372,826 and 3,482,724 teach an early base cup design having both circumferential and longitudinal ribbing but it does not address the present goal. U.S. Pat Nos. 3,948,404 and 4,241,839 disclose base cups having inwardly directed lips which engage containers having reentrant grooves disposed about their lower peripheries but do not disclose relevant structure. U.S. Pat. No. 4,170,622 teaches a method of fabricating reinforced blow molded articles which have ribs on their inner surfaces. Numerous other patents relating to rib reinforcing are disclosed and discussed in this patent.

SUMMARY OF THE INVENTION

The instant invention relates to a ribbed base cup. Such a base cup is intended for use with a container having a hemispherical bottom such as those blow molded from thermoplastic materials, for example, polyethylene terphthalate. The ribbed base cup exhibits necessary strength and rigidity while enjoying significant weight reduction over similar devices of the prior art. The ribs are preferably disposed on the inner surface of the base cup for cosmetic reasons and may be arranged in various generally symmetrical radial and circumferential patterns. For example, ribs on the sidewall portion of the base cup may be arranged in either a staggered configuration similar to brickwork or a uniform lattice pattern whereas the ribs on the bottom portion of the base cup may be arranged in various radial or circular patterns. Preferably, but not necessarily, the ribs may be disposed along various ines of stress concentration such as those corresponding to intersections of surfaces and planes. Various embodiments of the instant invention will be described in the subsequent description of the preferred embodiments. It should be understood, however, that the invention broadly covers base cups having reduced wall thickness and strength enhancing ribs disposed in various configurations and arrays about the base cup. The ribs provide an additional benefit in that the mold channels defining them encourage rapid and complete filling of the mold cavity during the molding process.

Thus it is an object of the instant invention to provide a base cup having the requisite strength and rigidity to maintain an associated container in an upright orientation.

It is a further object of the instant invention to provide a base cup having reinforcing ribs disposed in various circular and radial arrays.

It is a still further object of the instant invention to provide a base cup which exhibits a substantial weight reduction over similar prior art devices but which exhibits substantially equivalent strength and rigidity.

It is a still further object of the instant invention to provide a ribbed base cup having various configurations of ribs on the inner surface which exhibits both a weight reduction and substantially equivalent strength and rigidity in comparison to prior art devices.

Further objects and advantages of the instant invention will become apparent by reference to the appended drawings and following description of the preferred embodiments.

BRIEF DESCRIPTION OF THE DRAWINGS

FIG. 18 is a fragmentary, sectional view of a two liter base cup according to the instant invention taken along line 18—18 of FIG. 17;

FIG. 19 is a fragmentary, sectional view of a two liter base cup according to the instant invention taken along line 19—19 of FIG. 17;

FIG. 20 is a fragmentary, sectional view of a two liter base cup according to the instant invention taken along line 20—20 of FIG. 17;

FIG. 21 is a fragmentary, sectional view of a two liter base cup according to the instant invention taken along line 21—21 of FIG. 17; and FIG. 22 is a fragmentary, sectional view of a two liter base cup according to the instant invention taken along line 22—22 of FIG. 16.

DESCRIPTION OF THE PREFERRED EMBODIMENTS

Figure 1:
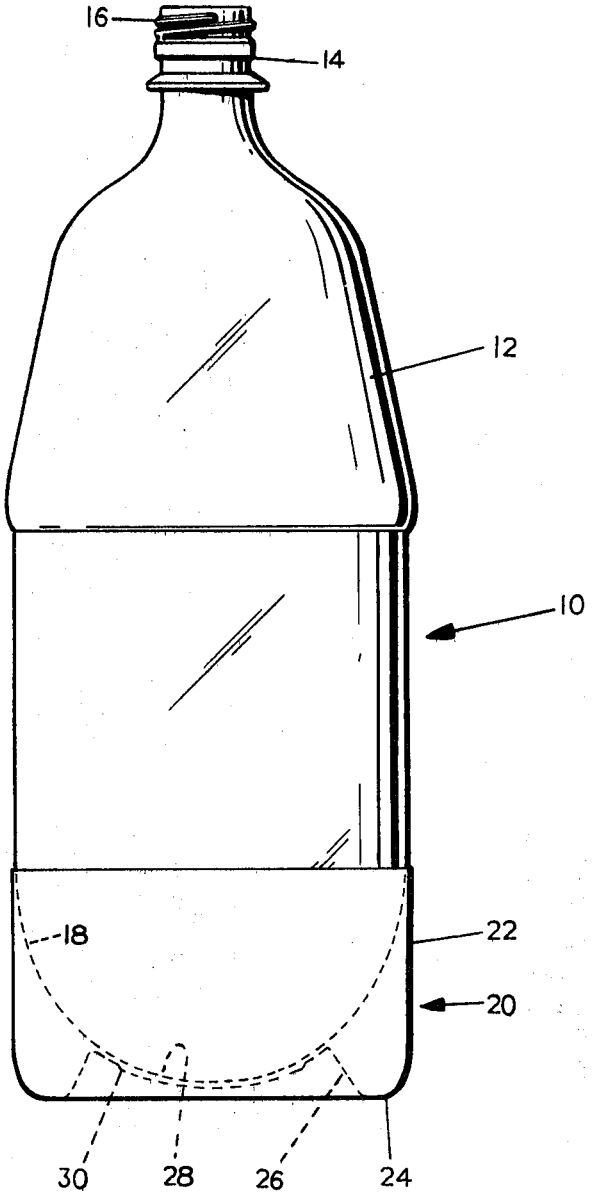
FIG. 1 is an elevational view of a container such as a beverage container received within a base cup according to the instant invention.

Referring now to FIG. 1, a two piece beverage container assembly incorporating the instant invention is illustrated and generally designated by the reference numeral 10. The beverage container assembly 10 comprises a blow molded fluid container 12 defining a volume which may be approximately one-half liter, one liter, two liters, or other volume and defines a finish 14 which may include threads 16 or similar closure structure to retain a complementarily configured closure (not illustrated). At the end of the container 12 opposite the finish 14 is a hemispherical bottom 18. As noted, the hemispherical bottom 18 represents an exceptionally viable compromise between the competing parameters of material consumption, strength, and manufacturing ease. The hemispherical bottom 18 of the container 12 is cradled and received within a base cup 20. The base cup 20 generally defines a sidewall 22 which frictionally contacts the lower sidewall region of the container 12, a seating ring 24 which contacts the surface upon which the container 12 and base cup 20 are disposed, a frustoconical support member 26, and a centrally disposed support platform 28 which is generally complementary, i.e., defines a portion of a sphere, to the hemispherical bottom 18 of the container 12 and thus receives and cradles the container 12. A layer of adhesive 30 disposed between the adjacent surfaces of the hemispherical bottom 18 of the container 12 and the support platform 28 secures the base cup 20 to the container 12. As noted above, the instant invention relates to the disposition of ribs on the surfaces of the base cup 20. Preferably, such ribs are disposed on the inner surface for cosmetic and aesthetic reasons. Furthermore, for various reasons such as strength and wall rigidity, various arrangements of circular and radial arrays of ribs are here proposed for various sizes of base cups such as those that accompany one-half, one, and two liter containers. These various arrangements of ribs on the base cup 20 according to the instant invention will now be described.

Figure 2:
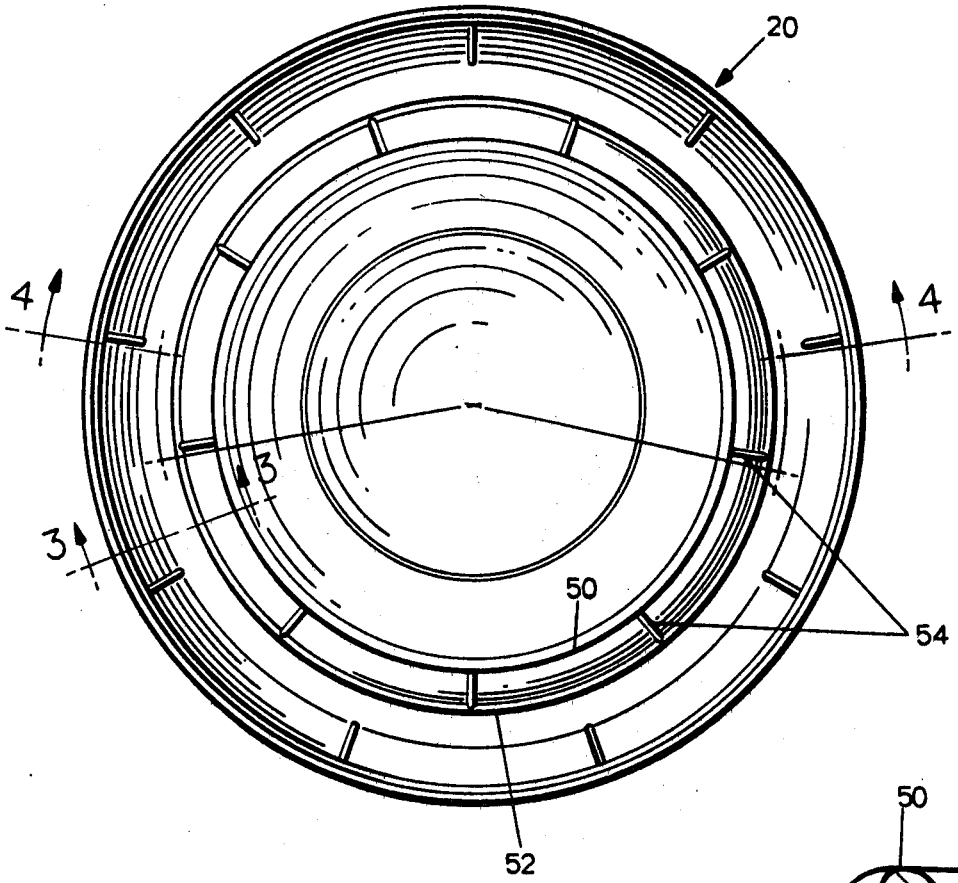
FIG. 2. is a plan view of a one-half liter base cup according to the instant invention.
Figure 3:
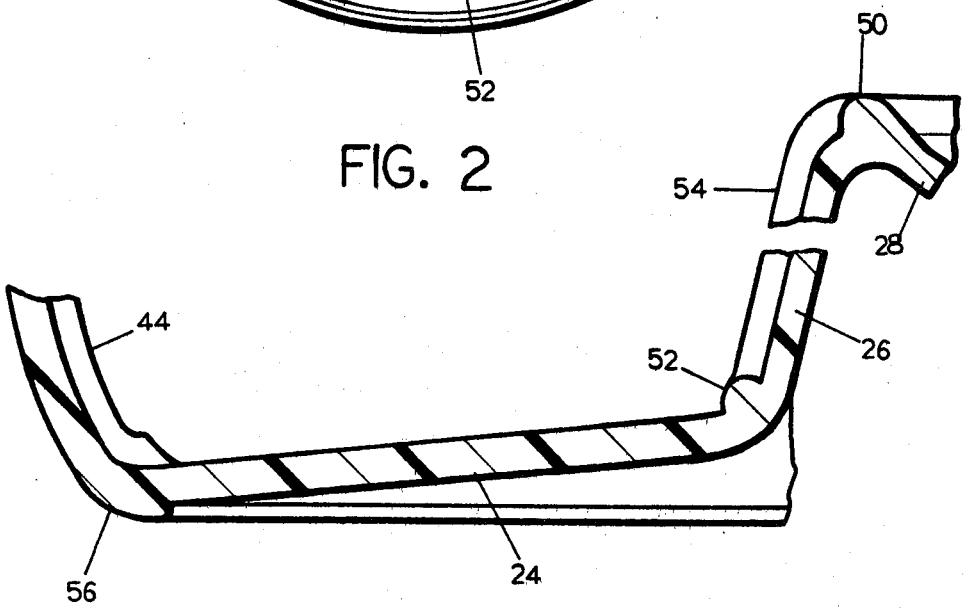
FIG. 3 is an enlarged fragmentary, sectional view of a one-half liter base cup according to the instant invention taken along line 3—3 of FIG. 2.
Figure 4:
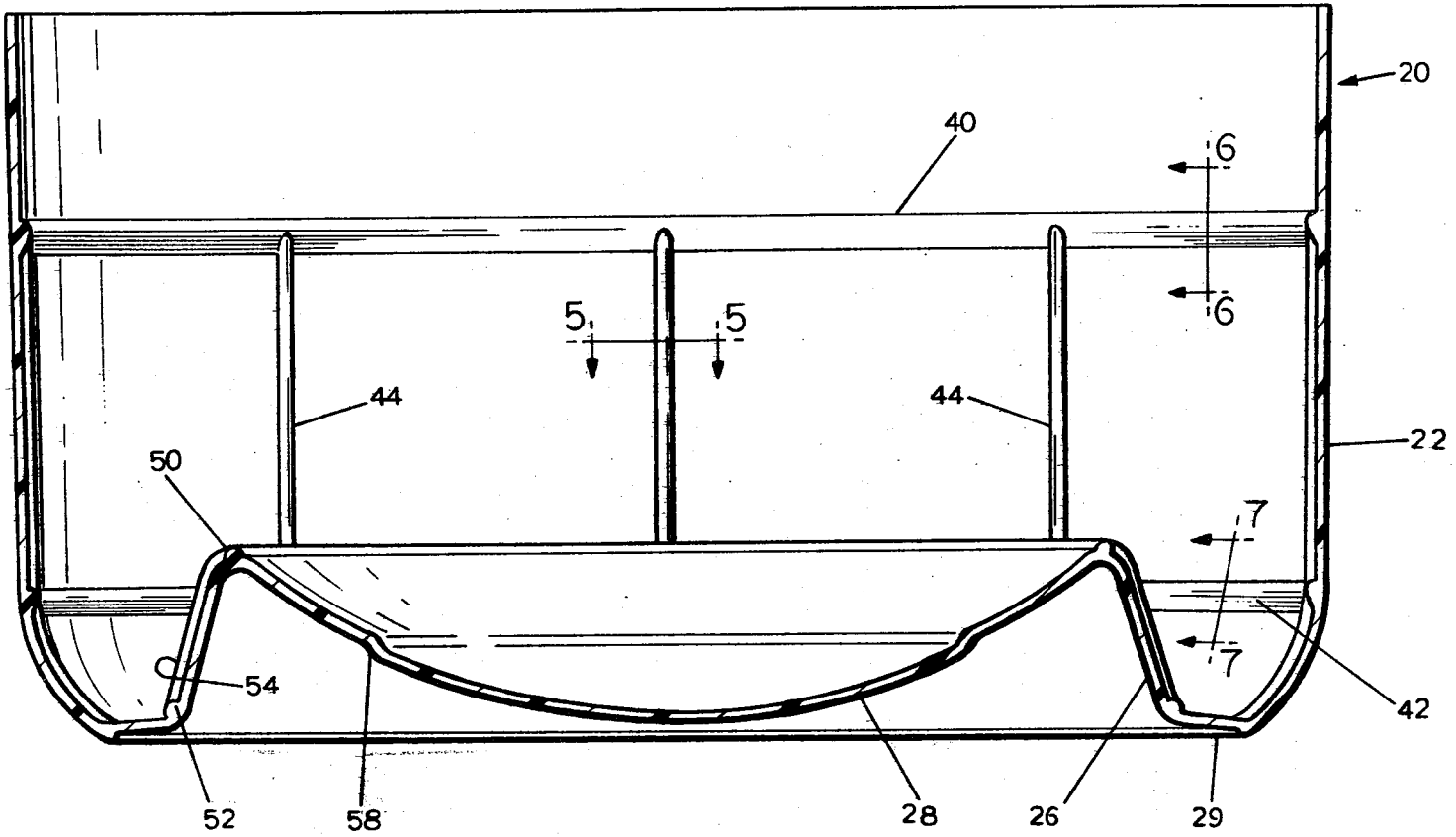
FIG. 4 is a full, sectional view of a one-half liter base cup according to the instant invention taken along line 4—4 of FIG. 2.

Referring now to FIGS. 2, 3, and 4, the base cup 20 for use with a container 12 having an internal volume of approximately one-half liter is illustrated. The base cup 20 includes the sidewall 22, the seating ring 24, the support member 26, and the support platform 28 discussed above. The base cup 20 also includes an upper circumferential rib 40 and a lower circumferential rib 42 on the inner surface of the sidewall 22. The ribs 40 and 42 are interconnected by a plurality of vertical ribs 44 which extend along the inner surface of the sidewall 22 beyond the lower circumferential rib 42 and into the region of the seating ring 24.

Figure 5:
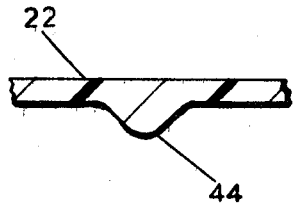
FIG. 5 is a fragmentary, sectional view of a one-half liter a base cup according to the instant invention taken along line 5—5 of FIG. 4.
Figure 6:
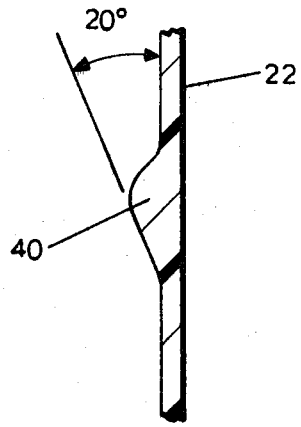
FIG. 6 is a fragmentary, sectional view of a one-half liter a base cup according to the instant invention taken along line 6—6 of FIG. 4.
Figure 7:
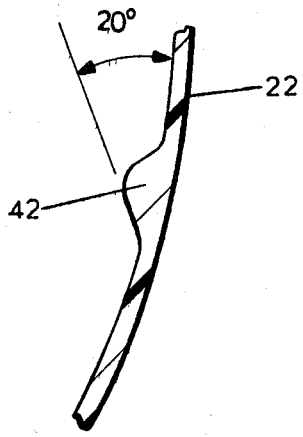
FIG. 7 is a fragmentary, sectional view of a one-half liter a base cup according to the instant invention taken along line 7—7 of FIG. 4.

Referring briefly to FIGS. 6 and 7, each of the ribs 40 and 42 defines a rounded, triangular profile having a downwardly or inwardly facing surface inclined at an angle of approximately 20° to the sidewall 22. This rib configuration facilitates removal of the base cup 20 from the components of the fabricating mold as those skilled in the art will readily appreciate. Referring briefly to FIG. 5, the profile of the vertical ribs 44 is therein illustrated and is generally symmetrical.

Referring again to FIGS. 2, 3, and 4, the support member 26 is also seen to include a pair of circular ribs 50 and 52 which are interconnected by a plurality of radially and conically oriented ribs 54. The upper rib 50 is disposed substantially at the intersection of the support member 26 with the support platform 28, the lower circular rib 52 is disposed substantially at the intersection of the seating ring 24 with the support member 26 and the plurality of ribs 54 extend therebetween along the inner surface of the support member 26. As FIG. 2 makes manifest, it is preferable that the ribs 44 of the sidewall are staggered, i.e., offset one-half the circumferential separation between adjacent ribs 44, relative to the radial ribs 54 disposed on the support surface 26. Also as illustrated in FIG. 2, nine of the ribs 44 and 54 are utilized. While this number of ribs has been found to be quite serviceable, nothing herein should be construed to either limit the invention to this precise number of ribs or to inhibit the use of a greater or lesser number of ribs in view of various strength and material utilization considerations. Referring particularly to FIG. 3, it should be noted that the base cup 20 includes a circumferential lip or projection 56 disposed about its circumference at the intersection of the sidewall 22 and the support ring 24. The projection 56 represents the lowermost portion of the base cup 20 and is the sole region of contact between the base cup 20 and the supporting surface (not illustrated). By locating this contact region at the outermost portion of the base cup 20, improved stability of the container 20 is achieved. As best illustrated in FIG. 4, the support platform 28 may also include a step or discontinuity 58 which delineates two regions in the support platform 28, the central or lower region providing space to receive any overflow of adhesive 30.

Figure 8:
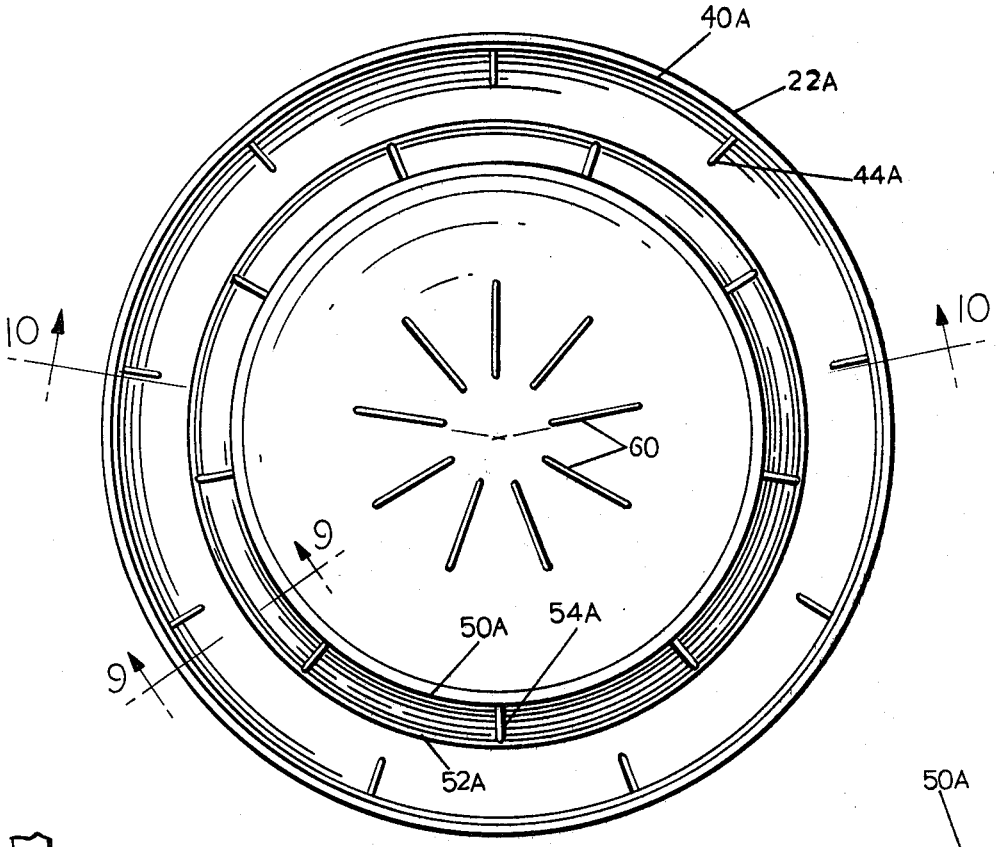
FIG. 8 is a plan view of an alternate embodiment of a one-half liter base cup according to the instant invention.
Figure 9:
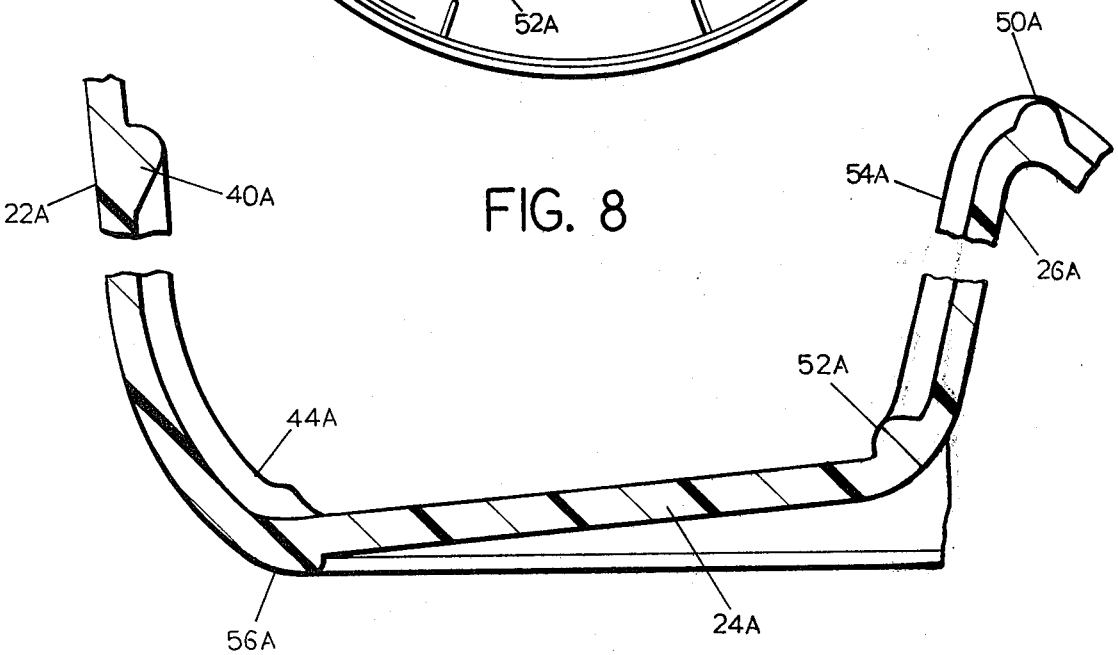
FIG. 9 is an enlarged fragmentary, sectional view of an alternate embodiment one-half liter base cup according to the instant invention taken along line 9—9 of FIG. 8.
Figure 10:
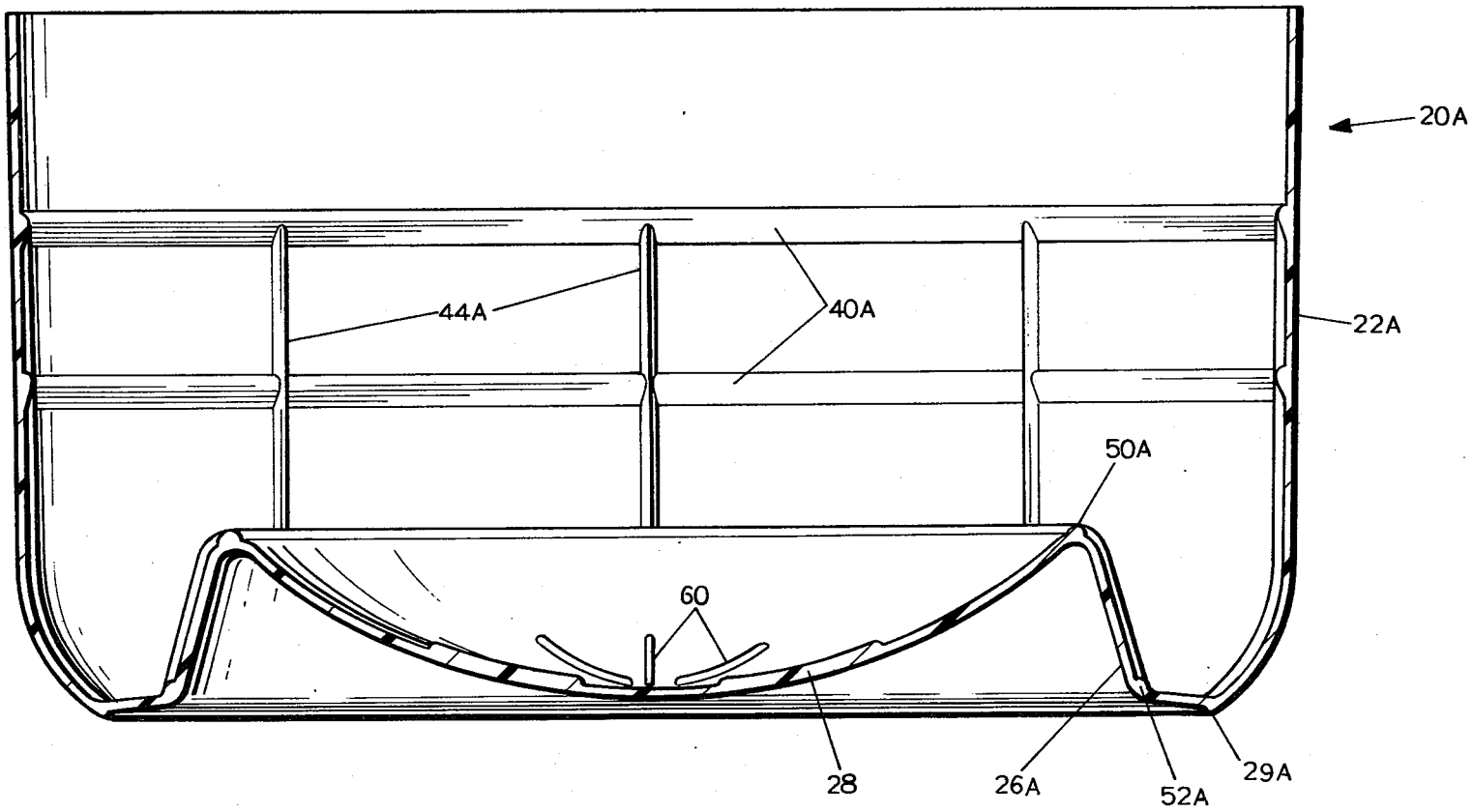
FIG. 10 is a full, sectional view of an alternate embodiment one-half liter base cup according to the instant invention taken along line 10—10 of FIG. 8.

Referring now to FIGS. 8, 9 and 10, an alternate embodiment one-half liter base cup 20A is illustrated. The alternate embodiment base cup 20A includes the sidewall 22A, a seating ring 24A, a support member 26A and a centrally disposed support platform 28A which are all analogous to the like numbered regions of the base cup 20. The alternate embodiment base cup 20A also includes a pair of parallel circumferential ribs 40A having a triangular profile as illustrated in FIG. 6. The circular ribs 40A are interconnected by a plurality of vertical ribs 44A which extend along the sidewall 22A and terminate where the sidewall 22A generally intersects the seating ring 24A. The vertical ribs 44A have a semi-circular profile as illustrated in FIG. 5. The alternate embodiment one-half liter base cup 20A also includes a pair of circular ribs 50A and 52A which are interconnected by a plurality of radially and conically disposed ribs 54A. Again, the plurality of ribs 54A are equal in number to the number of ribs 44A and are preferably staggered, i.e., circumferentially offset one-half the circumferential separation between the ribs 54A, from the outer plurality of ribs 44A. The alternate embodiment one-half liter base cup 20A also includes an array of radial ribs 60 disposed within the central lower region of the support platform 28A. Again, nine of the ribs 60 are illustrated and the ribs are aligned with the vertical ribs 44A. It should be understood however that greater or lesser number of the ribs 60 and alternate alignment arrangements may be utilized and are comprehended by the instant invention. The profiles of the ribs 50A, 52A, 54A and 60 are all semi-circular as illustrated generally in FIG. 5.

Figure 11:
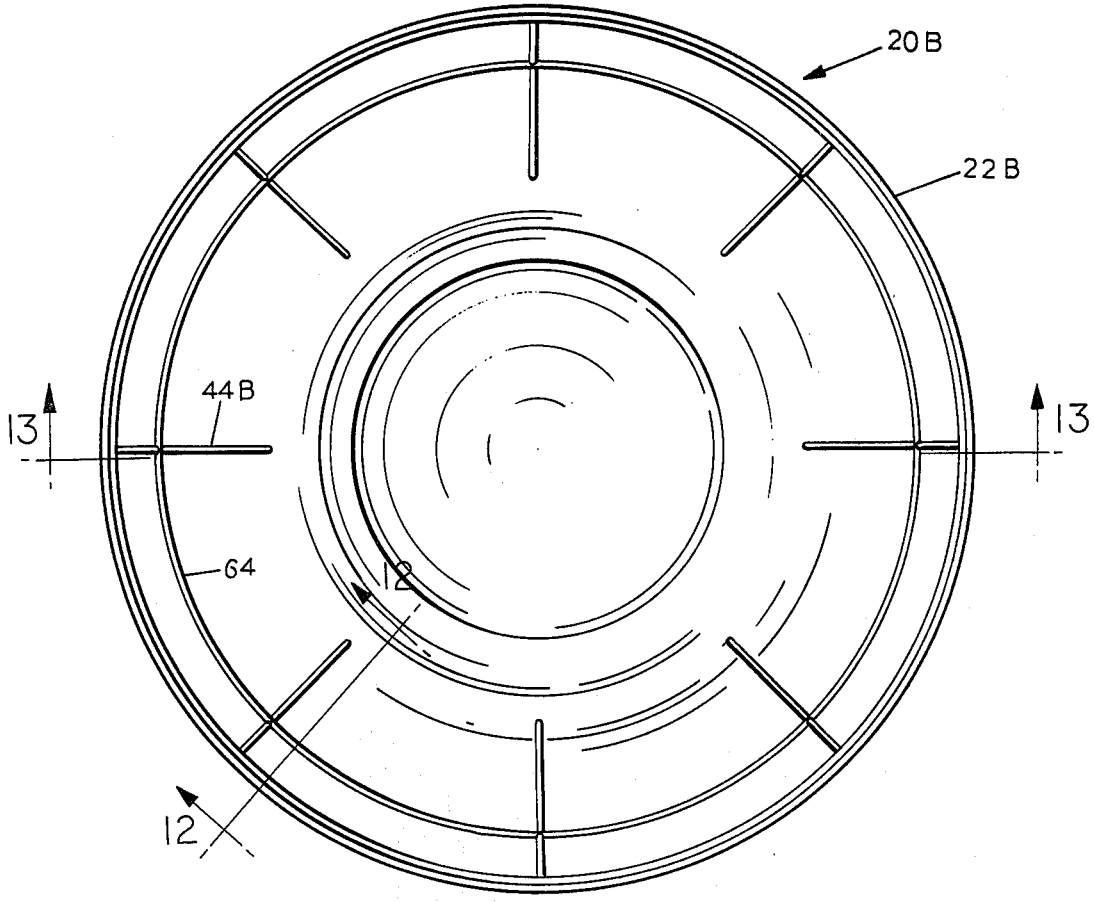
FIG. 11 is a plan view of a one liter base cup according to the instant invention.
Figure 15:
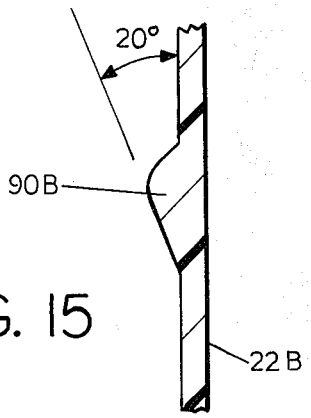
FIG. 15 is a fragmentary, sectional view of a one liter base cup according to the instant invention taken along line 15—15 of FIG. 13.
Figure 14:
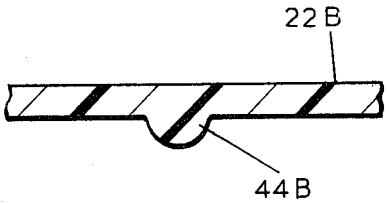
FIG. 14 is a fragmentary, sectional view of a one liter base cup according to the instant invention taken along line 14—14 of FIG. 13.
Figure 13:
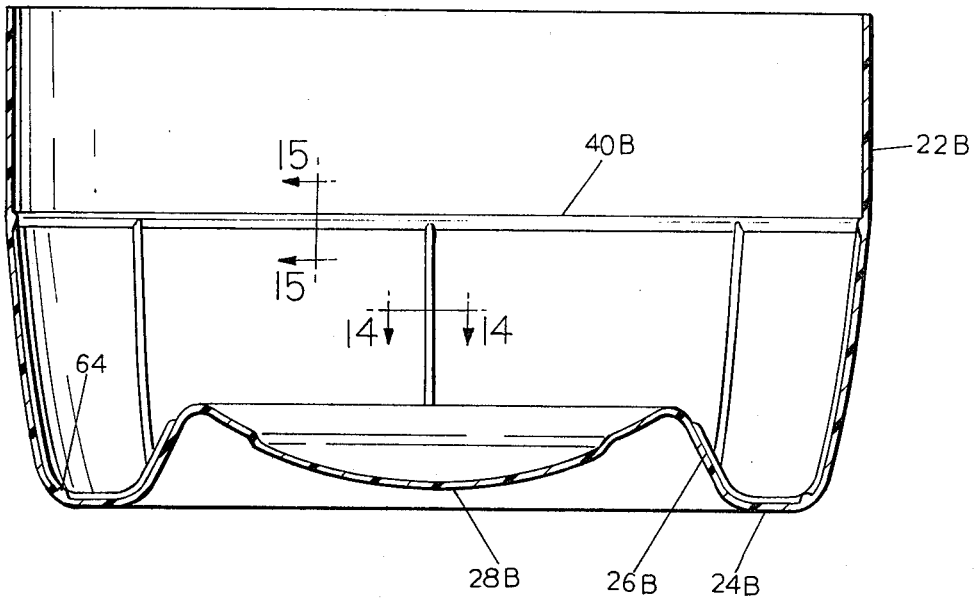
FIG. 13 is a full, sectional view of a one liter base cup according to the instant invention taken along line 13—13 of FIG. 11.
Figure 12:
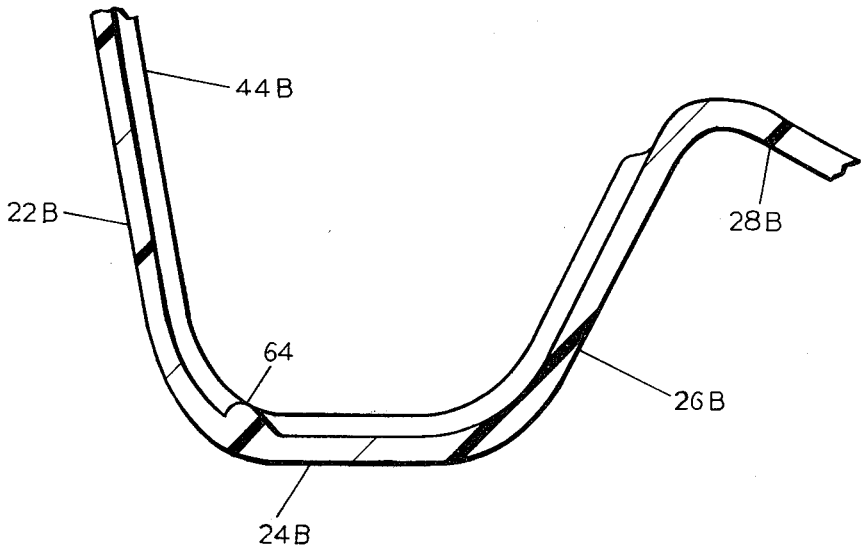
FIG. 12 is an enlarged, fragmentary, sectional view of a one liter base cup according to the instant invention taken along 12—12 of FIG. 11.

Turning now to FIGS. 11, 12 and 13, an embodiment 20B of a ribbed base cup according to the instant invention for use with a one liter container is illustrated. The one liter base cup 20B includes a sidewall portion 22B, a seating ring 24B, a support member 26B and a centrally disposed support platform 28B. These regions are analogous to the like-numbered regions of the base cup 20. The one liter base cup 20B also includes a single circumferential rib 40B which extends about the inner surface of the sidewall 22B at approximately its horizontal midplane. The rib 40B has a rounded, triangular profile as illustrated in FIG. 15 which includes a lower, inwardly directed surface which is disposed at an angle of approximately 20° to the upper portion of the sidewall 22B. As noted previously, the angled surface of the rib 40B facilitates removal of the base cup 20B from the fabricating mold. The region of sidewall 22B above the circumferential rib 40B is substantially vertical whereas the region of the sidewall 22B below the circumferential rib 40B is frusto-conical and tapers inwardly at a small acute angle. Depending from the circumferential rib 40B are a plurality of equally spaced apart ribs 44B which extend downwardly along the sidewall 22B, across the seating ring 24B and upwardly and inwardly along a portion of the support member 26B. As illustrated in FIG. 11, eight of the ribs 44B are utilized in the one liter base cup 20B but it should be understood that greater or fewer of the ribs 44B may be utilized. The one liter base cup 20B also finally includes a circumferential rib 64 disposed generally at the intersection of the sidewall 22B and the seating ring 24B. As illustrated, the circumferential rib 64 is intersected by each of the plurality of ribs 44B.

Figure 16:
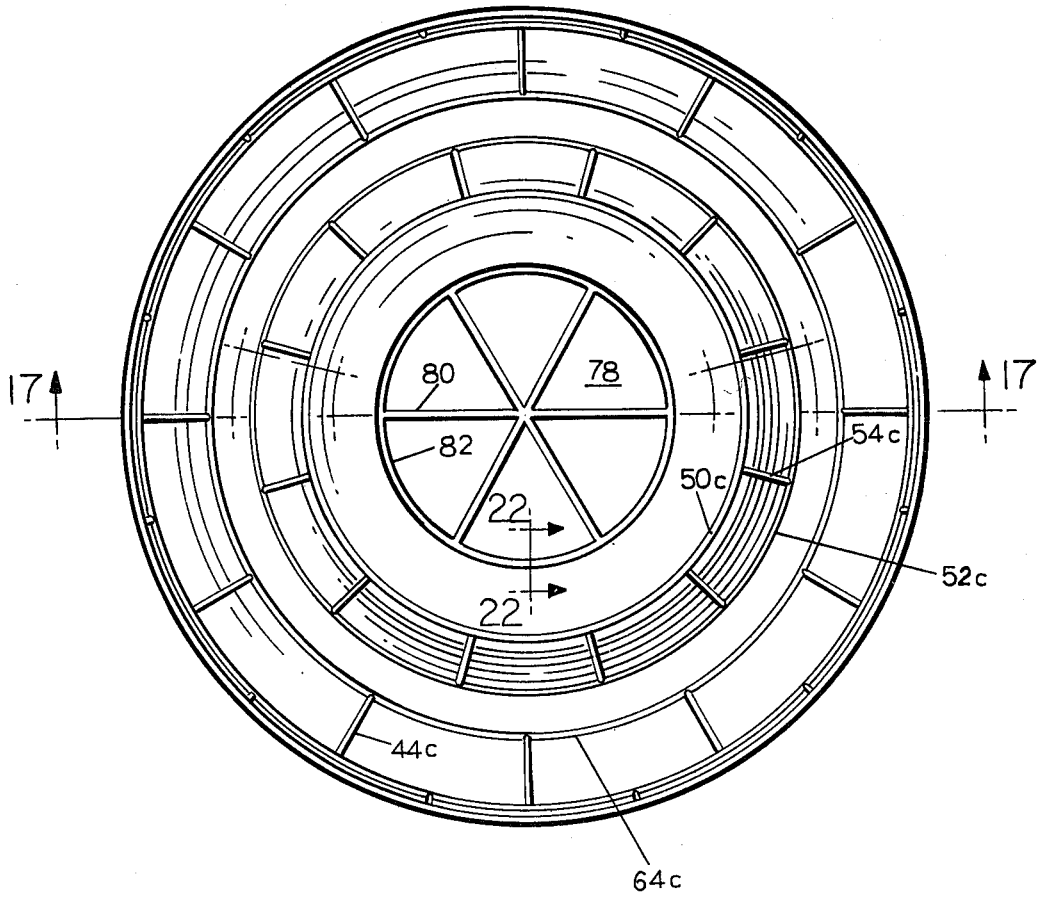
FIG. 16 is a plan view of a two liter base cup according to the instant invention.
Figure 17:
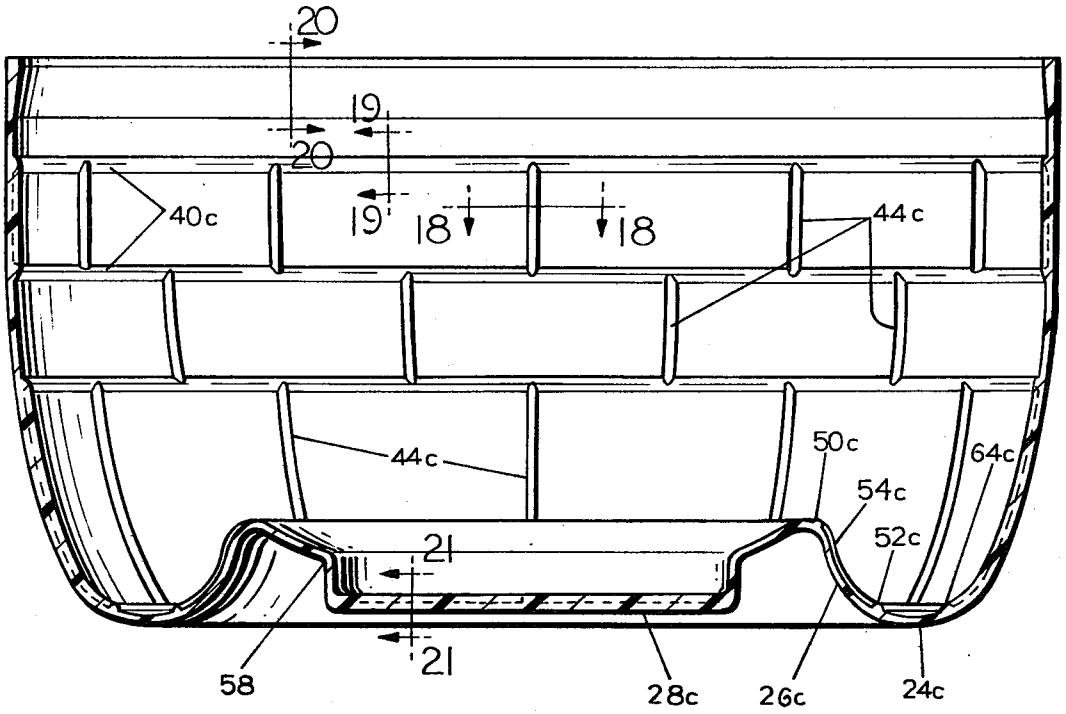
FIG. 17 is a full, sectional view of a two liter base cup according to the instant invention taken along line 17—17 of FIG. 16.

Turning now to FIGS. 16 and 17, an embodiment of a two liter base cup 20C is illustrated. The two liter base cup 20C again defines a sidewall 22C which merges with a seating ring 24C which is in turn connected to a support member 26C and a support platform 28C. As FIG. 17 makes manifest, the above delineated regions of the two liter base cup 20C are less precisely defined than those corresponding regions in the previously described embodiments. Nonetheless, it will readily be appreciated that these elements are analogous in both structure and function to the like numerically delineated elements in the previously described embodiments. Referring briefly to FIG. 20, the top adjacent region of the sidewall 22C generally defines a vertical outer surface 70 and an inner frusto-conical surface 72 which tapers downwardly and outwardly to define a thicker terminal wall portion 74 and a generally thinner wall region 76 which extends downwardly and intersects the seating ring 24C.

Referring again to both FIGS. 16 and 17, the sidewall 22C also includes a plurality of circumferential ribs 40C. The circumferential ribs 40C are three in number as illustrated but the number may obviously be increased or reduced in response to various required strength and design parameters. Referring briefly to FIG. 19, the profile of the circumferential ribs 40C is again generally triangular, having a lower surface inclined at an angle of approximately 20° to the vertical sidewall 22C in order to facilitate removal of the base cup 20C from the mold cavity. The plurality of circumferential ribs 40C are interconnected by a plurality of staggered vertical ribs 44C. As illustrated, there are twelve of the ribs 44C in each tier but it should be understood that this number may be increased or reduced if desired in response to various structural and design considerations. Rather than the staggered arrangement llustrated, the vertical ribs 44C may be alternatively arranged in an aligned configuration similar to the configuration illustrated in FIG. 10 with regard to the alternate embodiment one-half liter base cup 20A. In any case, the vertical ribs 44C extend from the lowermost of the circumferential ribs 40C and intersect and terminate at the points of intersection with a circumferential rib 64C formed on the seating ring 24C, a structure which is again analogous to the general configuration of the alternate embodiment one-half liter base cup 20A illustrated in FIG. 10. A first circumferential rib 50C extends about the inner surface of the ribbed base cup 20C generally adjacent the intersection of the support member 26C and the support platform 28C and a second concentric rib 52C extends about the inner surface of the ribbed base cup 20C at generally the intersection of the support member 26C and the seating ring 24C. The rib 52C is also preferably co-planar with the circumferential rib 64C. The support platform 28C also defines a significant step or discontinuity 58C. The circumferential ribs 50C and 52C are interconnected by a plurality of radially and conically disposed ribs 54C which are generally circumferentially aligned with the middle tier of ribs 44C on the sidewall 22C. Finally, the support member 28C of the second alternate embodiment ribbed base cup 20C defines a step 58C of somewhat greater magnitude than the step 58 in the one-half liter base cup 20 and the lower region of the support member 28C defines a circular, planar region 78 having a plurality of radial, intersecting ribs 80 disposed thereon. The ribs 80 have a trapezoidal profile as illustrated in FIG. 21. A circular rib 82 also is disposed at the outward termini of the ribs 80. The circular rib 82 is illustrated in cross-section in FIG. 22.

With regard to all of the embodiments illustrated previously in FIGS. 1 through 22, a general description of their structure and fabrication will now be undertaken. As should be apparent, the thrust of the instant invention is the utilization of ribs, preferably on the inner surface of a base cup, which permit reduced wall thickness in order to reduce the overall weight of the base cup and thus reduce material consumption while still providing the requisite strength and rigidity to the base cup. As noted previously, the sidewall 22 of the base cup 20 is primarily a cosmetic member which closes off the region adjacent the hemispherical bottom 18 of the container 12 whereas the support platform 28, the frusto-conical support member 26 and the seating ring 24 are primarily structural members which receive and support the container 12. Thus the uppermost region of the sidewall 22, i.e., that region above the circumferential rib 40 in the various embodiments may be less than 20 s in thickness, 17 mils having been found to be sufficient. The lower portion of the sidewall 22, i.e., that region of the sidewall 22 between the uppermost circumferential rib 40 and the intersection of the sidewall 22 with the seating ring 24 is preferably between about 20 and 25 mils in thickness, 22 mils having been found to exhibit appropriate strength characteristics. The seating ring 24, the frusto-conical support member 26 and the centrally disposed support platform 28 are preferably in the range of 23 to 27 mils, 25 mils having been found to provide appropriate strength and rigidity. It should be understood that these figures apply equally to all of the embodiments illustrated above. The rib thickness in all regions of the base cups 20 through 20C have been found to provide sufficient strength and rigidity in the range of from 35 to 50 mils, the range of from 40 to 45 mils being the optimum thickness from a rigidity versus material consumption standpoint. As an example of the weight reduction achieved by the instant invention at no sacrifice in strength and performance, the following example is noted. A conventional two liter base cup similar to that illustrated in FIGS. 16 and 17 weighs approximately 24 grams. The two liter base cup 20C according to the instant invention which corporates reduced wall thickness and ribs weighs approximately 18 grams and thus exhibits a 25 percent weight reduction over previous, prior art designs.

From a material standpoint, medium to high density polyethylene is the preferred material but many others exhibiting appropriate strength, plasticity and cost parameters will be apparent to those familiar with plastic molding art.

Finally, a peripheral benefit of ribbed base cups according to the instant invention and the molds that produce them should be noted. Since the mold portions which define and form the various ribs in the base cups of the instant invention are, of course, channels or grooves formed in the walls of the mold, the pathways which these rib-defining channels create markedly improve flow and uniform distribution of the thermoplastic material within and about the mold. Thus where plastic distribution may have been a problem in previous base cup designs having thicker sidewalls and bottoms, material distribution will generally be improved in molds which produce base cups according to the instant invention in spite of the fact that the sidewall regions and, to a lesser extent, the bottom panels are thinner because the rib-defining channels facilitate uniform distribution of the thermoplastic material.

Lastly, it should be understood that, in spite of the fact that all of the ribbed base cups 20 through 20C disclosed herein are circular, the instant invention is obviously adaptable to base cups having various profiles such as oval, elliptical or polygonal.

The foregoing disclosure is the best mode devised by the inventor for practicing this invention. It is apparent, however, that devices incorporating modifications and variations will be obvious to one skilled in the art of container related structures. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

What is claimed is:

1. A base cup for receiving a container having a generally spherical bottom comprising, in combination, an annular sidewall, a seating ring extending generally inwardly from said sidewall, a generally frusto-conical support member extending upwardly and inwardly from said seating ring and a support platform having a container receiving surface, at least one circumferential rib disposed on said annular sidewall, at lesat one lower rib disposed on said seating ring and a plurality of generally vertically oriented ribs extending between said circumferential rib and said lower rib, a pair of concentric ribs, one of said concentric ribs disposed generally at the intersection of said seating ring and said support member, the other of said concentric ribs disposed generally at the intersection of said support member and said support platform.

2. The base cup of claim 1, further including a plurality of generally conically arranged ribs disposed on said support member and intersecting said pair of concentric ribs.

3. The base cup of claim 4 wherein said ribs are disposed on the inner surface of said base cup.

4. The base cup of claim 1, further including a plurality of generally conically arranged ribs disposed on said support member between said pair of concentric ribs, said ribs being disposed on the inner surface of said base cup.

5. The base cup of claim 1, further including a plurality of generally conically arranged ribs disposed on said support member and intersecting said pair of concentric ribs, said ribs being disposed on the inner surface of said base cup.

6. A base cup for receivng a container having a hemispherical bottom comprising, in combination, an annular sidewall having a thickness of about 20 mils, a seating ring extending generally inwardly from said sidewall, a generally frusto-conical support member extending upwardly and inwardly from said seating ring and a support platform having a container receiving surface disposed within said seating ring, said seating ring, said support member, and said support platform having a thickness of about 25 mils, at least one circumferential rib disposed on said annular sidewall, at least one lower rib disposed on said seating ring and a plurality of generally vertically oriented ribs extending between and intersecting said circumferential rib and said lower rib, said ribs each having a thickness of about 40 to 45 mils, a second lower rib disposed generally on said seating ring and spaced inwardly from said lower rib, a third lower rib disposed generally at the intersection of said support member and said support platform, a plurality of generally conically oriented ribs on said support member extending between said second lower rib and said third lower rib, a circumferential step in said support platform and a plurality of radially oriented, intersecting ribs disposed on said support platform within said circumferential step.

7. A base cup for receiving a container having a hemispherical bottom comprising, in combination, an annular sidewall having a thickness of about 20 mils, a seating ring extending generally inwardly from said sidewall, a generally frusto-conical support member extending upwardly and inwardly from said seating ring and a support platform having a container receiving surface disposed within said seating ring, said seating ring, said support member, and said support platform having a thickness of about 25 mils, at least one circumferential rib disposed on said annular sidewall, at least one lower rib disposed on said seating ring and a plurality of generally vertically oriented ribs extending between and intersecting said circumferential rib and said lower rib, said ribs each having a thickness of about 40 to 45 mils, a second lower rib disposed generally on said seating ring and spaced inwardly from said lower rib, said ribs being disposed on the inside of said base cup.

8. The base cup of claim 7, further including a third lower rib disposed generally at the intersection of said support member and said support platform, said third lower rib being disposed on the inside of the base cup.

9. The base cup of claim 8, further including a plurality of generally conically oriented ribs on said support member extending between said second lower rib and said third lower rib, said conically oriented ribs being disposed on the inside of the base cup.

10. A plastic base cup for receiving a container having a hemispherical bottom comprising, in combination, an annular sidewall, a seating ring extending generally inwardly from said sidewall, a generally frusto-conical support member extending upwardly and inwardly from said seating ring and a support platform having a container receiving surface, at least one circumferential rib disposed on said annular sidewall, an annular thickened portion at substantially the intersection of the support member and the support platform, and a plurality of substantially conically extending ribs disposed on said support member and intersecting said thickened portion.

11. A base cup of claim 10, further including a plurality of radial ribs on said seating ring.

12. A base cup of claim 10 or 11, further including a second concentric ring at substantially the intersection of said seating ring and said support member.

13. The base cup of claim 10 or 11, further including a second concentric ring at substantially the intersection of said seating ring and said support member, a third concentric ring at substantially the intersection of the annular wall and the seating ring.

14. The base cup of claim 11, further including a plurality of generally vertical ribs on said annular wall.

15. The base cup of claim 11, further including a plurality of generally vertical ribs on said annular wall and a concentric ring at substantially the intersection of said annular wall and said seating ring and intersecting said vertical ribs and said radial ribs on said seating ring.

16. A base cup for receiving a container having a hemispherical bottom comprising, in combination, an annular sidewall, a seating ring extending generally inwardly from said sidewall, a generally frusto-conical support member extending upwardly and inwardly from said seating ring and a support platform having a container receiving surface, at least one circumferential rib disposed on said annular sidewall, a pair of substantially concentric ribs, one of said ribs disposed at substantially the intersection of said seating ring and said support member and the other of said ribs disposed at substantially the intersection of said support member and said support platform and a plurality of substantially conically extending ribs disposed between and intersecting said pair of concentric ribs.

17. The base cup of claim 16, further including a plurality of generally radially disposed ribs on said support platform.

18. The base cup of claim 16, further including at least an additional pair of circumferential ribs disposed on said annular sidewall and a plurality of vertically disposed ribs arranged in staggered relationship between and intersecting said circumferential ribs.

19. The base cup of claim 16, further including at least one additional circumferential rib disposed on said annular sidewall and a plurality of substantially vertical ribs extending at least between and intersecting said circumferential ribs.

20. The base cup of claim 16, 17, 18 or 19 wherein said ribs are disposed on the inner surface of said base cup.

21. The base cup of claim 16 wherein said circumferential rib is generally triangular in cross-section.

22. The base cup of claim 9, further including a circumferential step in said support platform and a plurality of radially oriented, intersecting ribs disposed on said support platform and encircled by said circumferential step.

* * * * *